US006857634B2

(12) United States Patent
Araujo

(10) Patent No.: US 6,857,634 B2
(45) Date of Patent: Feb. 22, 2005

(54) BOP ASSEMBLY WITH METAL INSERTS

(75) Inventor: Raul Araujo, Houston, TX (US)

(73) Assignee: Varco Shaffer, Inc., Houston, TX (US)

( * ) Notice: Subject to any disclaimer, the term of this patent is extended or adjusted under 35 U.S.C. 154(b) by 128 days.

(21) Appl. No.: 10/371,329

(22) Filed: Feb. 20, 2003

(65) Prior Publication Data

US 2004/0164494 A1 Aug. 26, 2004

(51) Int. Cl.[7] ..... E21B 33/06

(52) U.S. Cl. ..... 277/325; 277/619; 251/1.2; 251/325; 166/386; 166/85.4

(58) Field of Search ..... 277/325, 619; 251/1, 2, 325; 175/195; 166/386, 85.4

(56) References Cited

U.S. PATENT DOCUMENTS 4,229,012 A 10/1980 Williams, III
4,332,367 A 6/1982 Nelson
4,550,895 A 11/1985 Shaffer
5,011,110 A 4/1991 Le
6,296,225 B1 10/2001 Watts
6,367,804 B1 * 4/2002 Watts ..... 277/325

* cited by examiner

*Primary Examiner*—Alison Pickard
*Assistant Examiner*—Enoch Peavey
(74) *Attorney, Agent, or Firm*—Guy McClung; Loren Helmreich

(57) ABSTRACT

A blowout preventer assembly 10 includes opposed rams 12, 14, each including a rubber or elastomer sealing assembly 16, 18, with a plurality of inserts 20 forming an array 22 of metal inserts within each sealing assembly. Each insert has an upper body 24, a lower body 26, and a rib 50. Each upper and lower body includes a trailing face 36, a radially outward opposite face 38 and a leading face 40. An antiextrusion ledge 46 minimizes the extrusion gap between the OD of a tubular in the BOP and the leading face of the metal inserts in the array.

20 Claims, 6 Drawing Sheets

BOP ASSEMBLY WITH METAL INSERTS

FIELD OF THE INVENTION

The present invention relates to a BOP assembly commonly used for sealing with oilfield tubulars. More particularly, this invention relates to improvements in the metal inserts provided within the seal mechanisms of the sealing assembly.

BACKGROUND OF THE INVENTION

Blowout preventers used in hydrocarbon recovery operations have traditionally been manufactured with radially opposing rams that move inward to seal against the tubular, then move outward to let a tool joint pass by the BOP. Each sealing ram contains a relatively large elastomer for accomplishing the desired seal with both the tubular and with the opposing ram.

In order to provide more reliable BOPs capable of withstanding higher pressure differentials, metal inserts have been provided within the elastomer of the BOP rams. U.S. Pat. No. 4,229,012 discloses a ram-type blowout preventer with metal inserts as shown in FIG. 3A. Metal plates are positioned above and below the sealing portions, and a pin extends through each side sealing portion and into the plates. A connecting mechanism is provided for connecting the side portions to a packer ram. The blowout preventer disclosed in U.S. Pat. No. 4,332,367 includes adjoining metal inserts each configured as shown in FIG. 3. The metal inserts disclosed in U.S. Pat. No. 4,444,404 are configured to slide circumferentially with respect to adjoining inserts during the process of expanding or reducing the sealing diameter of the blowout preventer. U.S. Pat. No. 4,550,895 discloses metal reinforcements bars which are embedded in the elastomer of each ram of a BOP. The metal inserts disclosed in U.S. Pat. No. 5,011,110 include circumferentially extending flanges for fitting within the recess of an adjoining insert.

Blowout preventers have used metal inserts which move relative to one another in the manner of an iris to vary the diameter of the BOP bore. U.S. Pat. No. 6,296,225 discloses a BOP with metal inserts designed to move in this manner within each opposing ram of the BOP. U.S. Pat. No. 6,367,804 discloses inserts with a pillar to interconnect the upper body and the lower body of each insert. FIGS. 9 and 11 provide perspective views and a suitable insert according to the '804 patent.

Prior art BOPs have various disadvantages which have limited their acceptance in the oil and gas exploration and recovery industry. Some of the limitations in prior art BOPs concern the large diameter of the blowout preventer, which ideally is as small as possible both in vertical height and in the overall diameter, while also reliably sealing against a wide range of tubular diameters. Although BOPs that use metal inserts are able to withstand higher pressures than BOPs without such inserts, the metal inserts have difficulty with reliably sealing against a high pressure differential across the closed BOP. Improved techniques are thus required to provide a more reliable BOP which does not have the disadvantages of the prior art, may be manufactured and serviced at a relatively low cost, and which substantially minimizes or prevents extrusion of the BOP sealing material.

The disadvantages of the prior art overcome by the present invention. An improved blowout preventer and a sealing ram for the blowout preventer are hereinafter disclosed, with the sealing assembly including a plurality of metal inserts with improved characteristics compared with prior art inserts.

SUMMARY OF THE INVENTION

The BOP of the present invention provides for high sealing reliability, while also sealing with tubulars over a wide range of tubular ODs. The metal inserts are typically arranged in a circumferential and flange array. The inserts each have a generally triangular configuration, and are arranged to slide in an iris manner with respect to each other The number of cicumferentially spaced inserts provided will depend upon the sealing diameter requirements of the BOP. The inserts may be arranged in an array for expanding in either a clockwise or counterclockwise direction.

It is a feature of the invention that the angle of the outward face for each insert is about 20° to about 30° with respect to the leading face.

A related feature of the insert is that the opposite face of the triangular insert is angled from about 10° to about 30° with respect to a tangent to the bore, thereby providing a highly reliable BOP assembly with a relatively low diameter.

DESCRIPTION OF THE PREFERRED EMBODIMENTS

Figure 1:
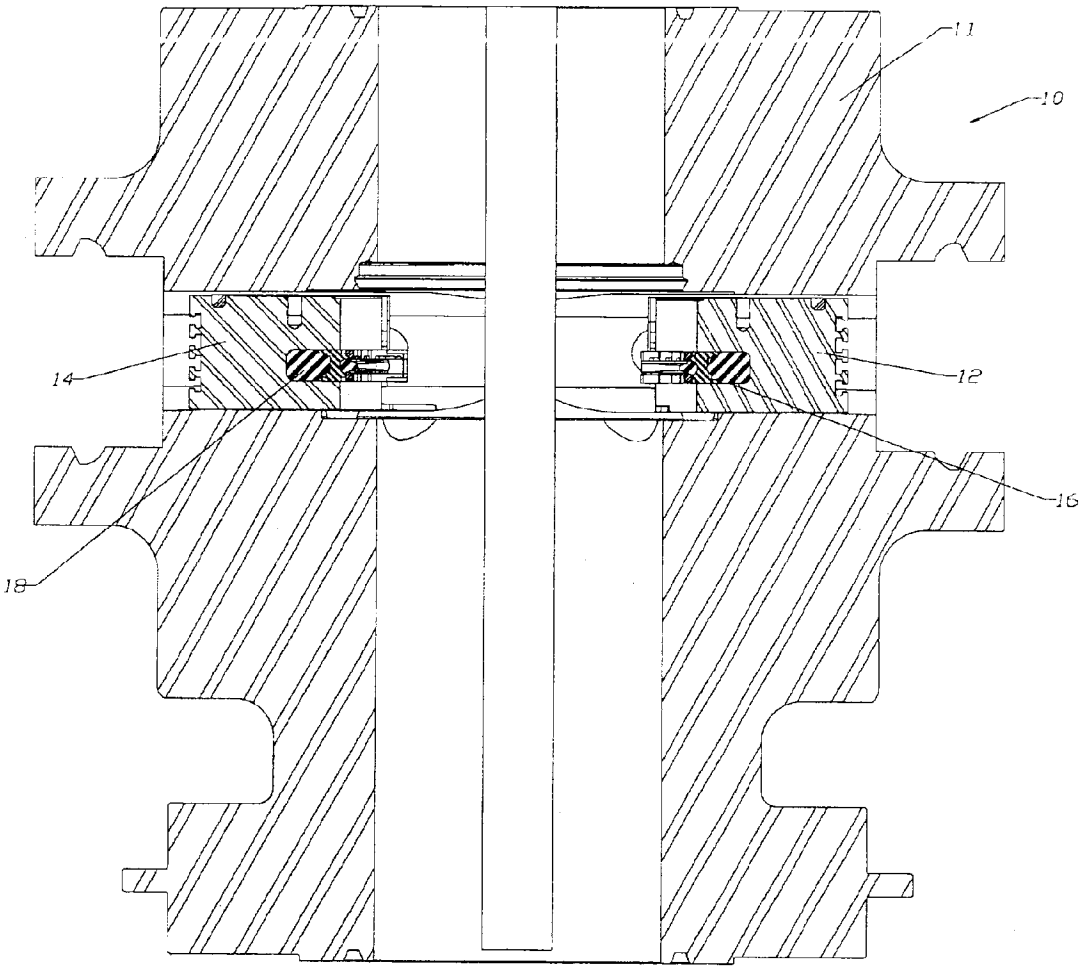
FIG. 1 is a side view, partially in cross-section, of an exemplary embodiment of a blowout preventer according to the present invention.
Figure 2:
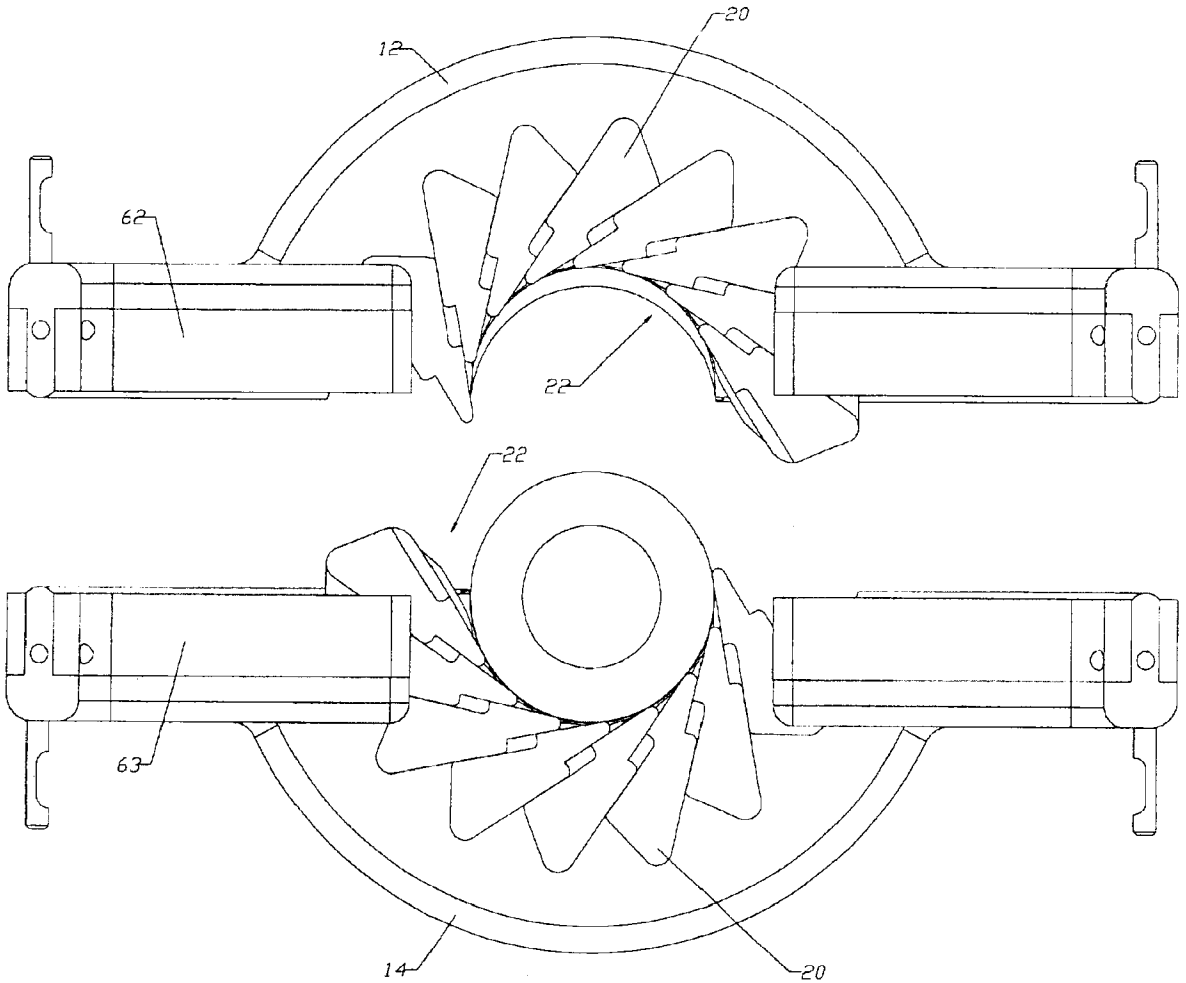
FIG. 2 is a top cross-sectional view illustrating the metal inserts in the sealing assemblies, with the lower ram assembly shown in engagement with a tubular, and the upper ram assembly shown in its expanded diameter position.
Figure 3:
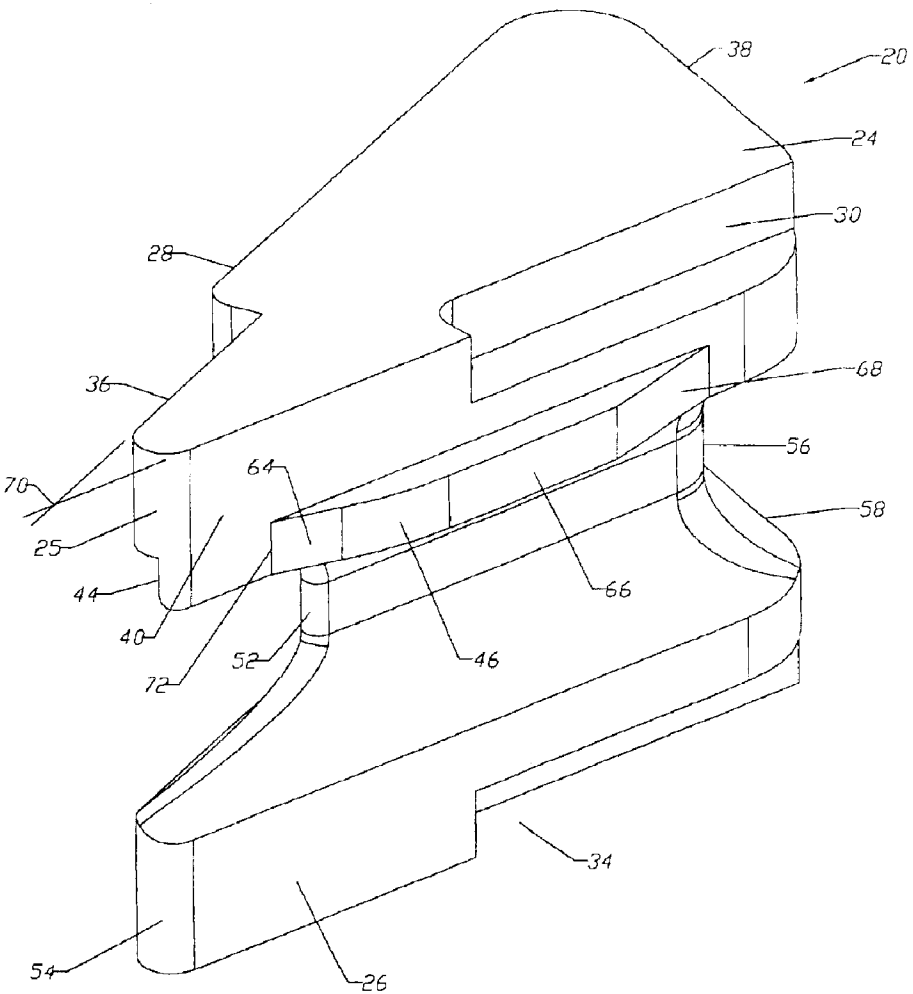
FIG. 3 is a pictorial view of one of the metal inserts generally shown in FIGS. 1 and 2.

The BOP assembly 10 includes a housing 11 with a central bore for receiving a drill pipe DP and radially opposing ram block assemblies 12, 14 each including a rubber or elastomer material sealing assembly 16, 18 for sealing engagement with the drill pipe DP or other tubular passing through the BOP. Each of the sealing assemblies includes a plurality of inserts 20, as shown in FIGS. 2 and 3, with the inserts arranged within the sealing assembly to form an array 22 of metal inserts within each ram block assembly. The radially outward end of each ram block assembly is adapted for engagement with the end of a hydraulically powered ram (not shown). Conventional opposing rams for powering the rams are well known in the art, and are typically included within the BOP assembly. Suitable hydraulically powered rams are disclosed in the prior art patents discussed above, and are incorporated by reference herein.

Figure 4:
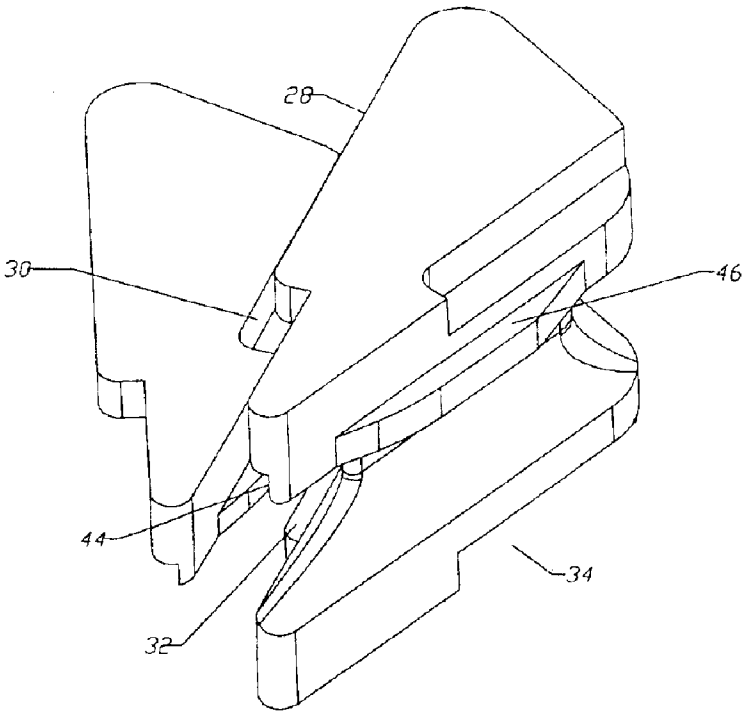
FIG. 4 is another view of the insert shown in FIG. 3, with an adjacent insert shown in dashed lines.

The generally triangular shaped metal inserts 20 as shown in FIG. 3 cooperate with each other to radially expand and contract in a uniform manner while moving with respect to adjacent inserts in an iris pattern. Each insert 20 is generally triangular in the sense that its upper body 24 and its lower body 26 have a generally triangular configuration when looking down on an insert along an axis generally parallel to the central axis of the tubular and thus the bore of the BOP. A suitable insert 20 includes an upper body 24 with a left-side ledge 28 and a right-side recess 30. The lower body 26 similarly may include a left-side ledge 32 (see FIG. 4) and a right-side recess 34. The upper ledge 28 and the lower ledge 32 (see FIG. 4) thus each partially fill the respective recesses or cavities 30, 34 to interconnect the circumferentially overlapping inserts in the array. In alternate embodiments, the ledge and recess on the lower body may be opposite the ledge and recess on the upper body. The upper recess may alternatively be provided on one side of the insert and the lower recess provided on the opposing side of the insert.

Figure 7:
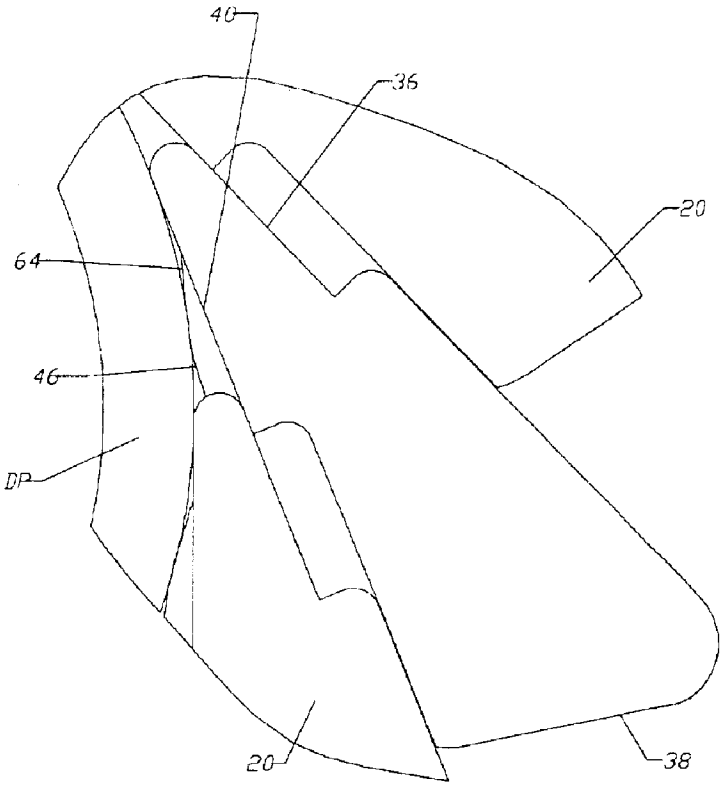
FIG. 7 illustrates in greater detail the slight gap adjacent an antiextrusion ledge.
Figure 5:
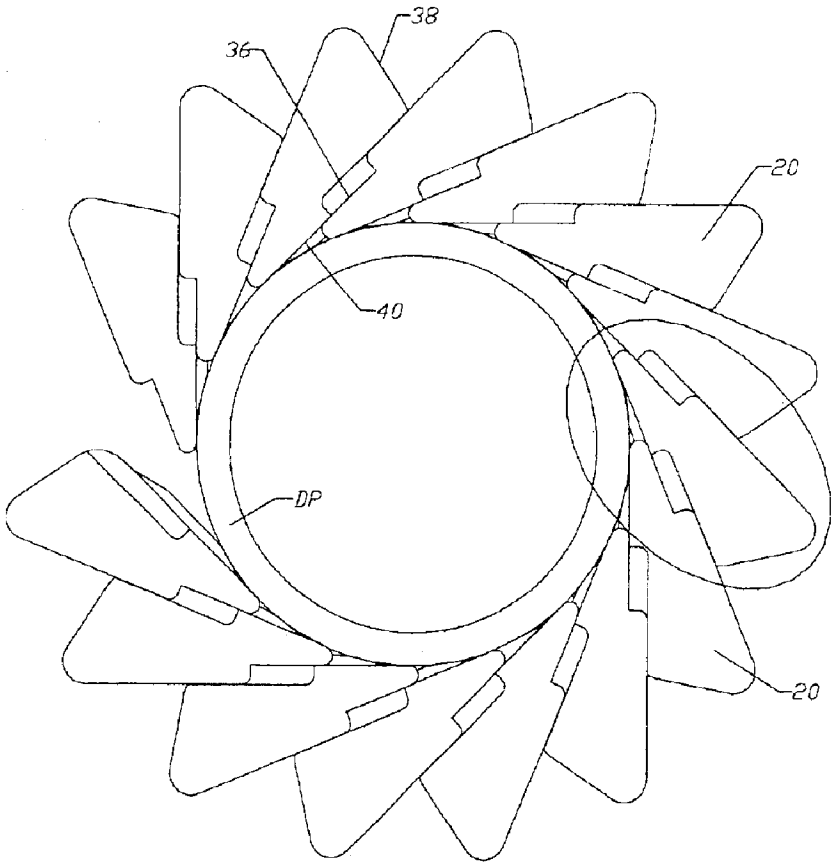
FIG. 5 illustrates circumferentially arranged inserts positioned for sealing the BOP assembly on a large diameter tubular, with the sealing material removed for clarity.
Figure 6:
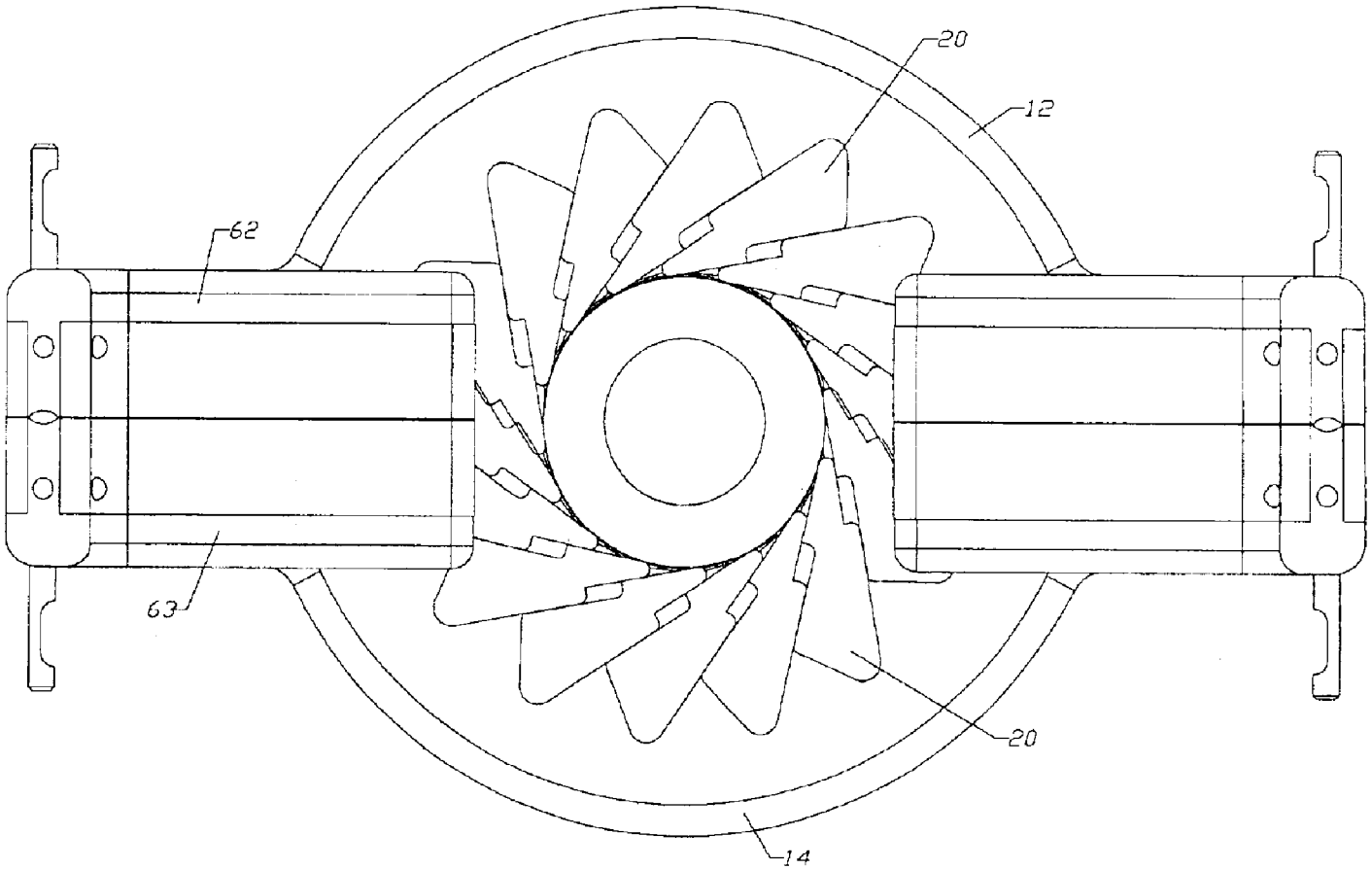
FIG. 6 is a top view illustrating the circumferentially arranged inserts positioned for sealing engagement with a small diameter tubular, with the sealing material removed for clarity.

As shown in FIG. 3, the upper body 24 and the lower body 26 of each triangular shaped insert 20 are each provided with a trailing face 36, a radially outward opposite face 38, and a leading face 40. In the preferred embodiment, trailing face 36 is angled from about 20° to about 30° with respect to leading face 40, which is generally tangent to the bore at the point of contact with the drill pipe DP, as shown in FIGS. 5–7. The radially outward opposite face 38 on the upper and lower body of each insert is preferably angled from about 50° to 80° with respect to the leading face 40. If the angle of the radially outward face 38 is increased to more than about 40° with respect to a tangent to the bore, more area is available for elastomeric material to act on the radially outward face and thus desirably force the insert into tighter engagement with the adjacent insert. An angle in excess of 40°, however, also effectively restricts the length of the cavities 30, 34 in the upper and lower bodies for receiving the corresponding ledges, or increases the radial length of each insert and thus the diameter of each sealing assembly, and thus the overall diameter of the BOP.

To obtain a desired relatively low diameter BOP, the above angular range for the opposite face 38 maximizes the ability of the inserts 20 to reliably slide inward toward the center of the bore and outward away from the center of the bore in unison with other inserts during closing and opening of the array. This feature further minimizes the sliding friction of each insert by avoiding excessive loads on the sliding insert surfaces during closing of the segment array.

Each insert 20 may be provided with upper and lower body as discussed above, and an integral rib 50 connecting the upper and lower bodies of each insert. The design of the rib 50 allows for rubber or elastomeric material between the metal inserts in the array, with the rib of each insert interconnecting the upper body and the lower body to position each insert within the sealing assembly to achieve the desired result. The rib 50 of each insert thus includes a front surface 52 which is spaced radially outward from a radially innermost surface 54 of the insert, and a radially outer surface 56 spaced radially inward of a radially outermost surface 58 of each insert. The inserts 20 may be provided in the semi-circular portion of each ram block assembly 12, 14, and may also be provided in each of the pair of leg members 62 and 63 (see FIG. 2) extending radially outward from an end of each semi-circular portion.

According to a preferred embodiment, a radially inwardly directed antiextrusion ledge 46 on each insert 20 extends from the leading face 40 of the insert upper body 24 to minimize the extrusion gap which otherwise occurs on either the small diameter BOP, the large diameter BOP, or both. The resistance of the rubber or elastomer to extrusion decreases dramatically when exposed to high temperatures. By closing of this extrusion gap with ledge 46 on each insert, the BOP may be more reliably used in high temperature and/or high pressure differential operations. The antiextrusion ledge 46 is provided in the upper body of each insert, since the top of the sealing assembly 16, 18 is subjected to the greatest pressure differential and is thus most likely to experience extrusion of the elastomeric material. An antiextrusion ledge 46 and a corresponding slot for receiving that ledge could also be provided in the lower body of each insert.

The antiextrusion ledge 46 protrudes from each insert's upper body and slides into a slot 44 (see FIGS. 3 and 4) within the upper body of an adjacent metal insert. The slot 44 has a thickness to receive the extension ledge 46, and significantly decreases the extrusion gap and provides increased rubber containment, thereby improving the seal performance under both conventional and high pressure operating conditions. Each antiextrusion ledge 46 thus extends in an opposite direction from the trailing face 36 with respect to the leading face 40 of the insert 20. The antiextrusion ledge is primarily designed to minimize the extrusion gap between the OD of the tubular within the BOP and the leading face 40 of each metal insert in the array. By minimizing this extrusion gap, the ability of each insert to support and constrain the sealing material in the elastomeric material during multi-ram sealing operations is significantly increased.

Each antiextrusion ledge 46 includes an initial ledge portion which is recessed from a preferably rounded tip 25 of each upper body 24. The position of the antiextrusion ledge is a function of the range of pipe ODs intended for reliably sealing with the seal assembly including the inserts 20, with the inserts providing the desired support for reliable seal operation. An exemplary array of segments according to the present invention moveable in an iris pattern is intended for reliable operation within a sealing assembly for a range of tubulars from about 3.5 inch OD pipe through 7.625 inch OD pipe. The antiextrusion ledge 46 is preferably positioned substantially midway between the maximum and minimum range of pipe ODs, which for the above design would be a 5.875 inch OD pipe. The antiextrusion ledge is located next to the 5.875 inch OD pipe, but avoids interference between the drill pipe DP and the ledge 46, as shown in FIG. 7. In this position, the antiextrusion ledge 46 minimizes the extrusion gap between the segments in the iris array and the 5.875 inch OD pipe. For the smallest pipe OD, e.g., 3.5 inch OD, the extrusion gap is larger, and increases with larger diameter pipe. Since the tip of the segments come closer together, the ledge 46 cannot provide as much support for the rubber, but still provides substantially more support than prior art segments without the antiextrusion ledge.

The preferred location of the antiextrusion ledge should be appreciated by recognizing the ledge's position in the iris array when the extrusion gap is smallest, e.g., the 3.5 inch OD pipe. The ledge 46 should not contact the pipe before the upper body 24 of the insert otherwise contacts the pipe, or the ledge 46 may be destroyed since it likely would be too small to support the contact stresses created during sealing engagement of the sealing assembly with the pipe. Accordingly, the ledge 46 is ideally located at a position dictated by a mid-range between the minimum and the maximum OD pipe intended for use with the BOP assembly.

The extent of the spacing from the imaginary apex point 70 of the upper body 24 of each triangular insert to the beginning 72 of each ledge 46 will vary with the requirements of each blowout preventer, but preferably the spacing between the point 70 and the starting point 72 of each antiextrusion ledge will be at least 5% of the average or nominal diameter of the BOP, which thus provides sealing engagement with a smaller diameter tubular and a larger diameter tubular. The antiextrusion ledge extends from point 72 along curved ramp portion 64 (see FIGS. 3 and 7) and then terminates in face surface 66, which may be substantially parallel to the leading face 40 of the upper body 24. The radially outward portion of each antiextrusion ledge extends along taper 68 back to the leading face of the upper body. The slot 44 in the adjacent insert is sized to receive ledge 46.

By spacing the antiextrusion ledge from the radially inner portion of the insert, there is less likelihood of having a tubular connection "hang up" on a relatively thin and thus weak part of the antiextrusion ledge, which could damage the antiextrusion ledge. Accordingly, configuring the antiextrusion ledge 46 as discussed above substantially reduces the likelihood of extrusion of the elastomeric material, yet effectively makes the antiextrusion ledge strong and therefore resistant to damage if a tubular connection hangs up on an insert.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A blowout preventor for sealing engagement with a tubular within a wellbore, comprising:

a blowout preventor body with a central bore;

a pair of opposing ram block assemblies, each ram block assembly including a ram block at an inner end of a cylinder rod;

a seal assembly carried by each ram block and radially moveable for sealing engagement and disengagement with the tubular, each seal assembly including a resilient seal for sealingly engaging the tubular and a plurality of inserts at least substantially embedded within the resilient seal for preventing extrusion of the resilient seal;

each insert including a generally triangular shaped upper body, a generally triangular shaped lower body, and a rib fixedly interconnecting the upper body and the lower body, each upper body and lower body having a leading face, a trailing face, and a radially outward opposite face;

a ledge in the upper body extending from one of the leading face and the trailing face in a direction away from the rib:

a recess in the upper body of an adjacent insert extending toward the rib of the adjacent insert to receive the ledge and circumferentially interconnect the inserts;

an antiextrusion ledge extending from the ledge in the upper body; and an antiextrusion slot in the trailing face of the upper body for receiving the antiextrusion ledge of an adjacent insert.

2. A blowout preventor as defined in claim 1, wherein the plurality of inserts move in an iris pattern to alter a bore diameter of the blowout preventor.

3. A blowout preventor as defined in claim 1, wherein the lower body include another circumferentially extending ledge extending from one of the leading face and the trailing face, and a recess in the other of the leading face and the trailing face for receiving an adjacent ledge.

4. A blowout preventor as defined in claim 3, wherein each of the ledge in the upper body and the another ledge in the lower body extend from the trailing face.

5. A blowout preventor as defined in claim 1, wherein the antiextrusion ledge of each insert includes a curved ramp portion commencing with a starting point spaced radially outward from a radially innermost portion of the leading face.

6. A blowout preventor as defined in claim 5, wherein a radial spacing between an imaginary apex of the upper body and the starting point of each curved ramp portion is at least 5% of a nominal diameter of the blowout preventor.

7. A blowout preventor as defined in claim 5, wherein the antiextrusion ledge of each insert includes face surface spaced radially outward from the curved ramp portion and substantially parallel to the leading face of the upper body.

8. A blowout preventor as defined in claim 1, wherein the rib of each insert includes a front surface spaced radially outward of a radially innermost surface of the insert and a rear surface spaced radially inward of a radially outermost surface of the insert.

9. A blowout preventor as defined in claim 1, further comprising:

the resilient seal having a generally semi-circular portion and a pair of opposing leg members each extending radially outward from each end of the semi-circular portion; and additional metal inserts positioned within each of the leg members.

10. A blowout preventor as defined in claim 1, wherein the antiextrusion ledge of each insert commences with a starting point spaced radially inward of a radially innermost portion of the ledge in the upper body.

11. A blowout preventor as defined in claim 1, wherein the antiextrusion ledge is spaced in a direction along the central bore between the ledge in the upper body and the rib.

12. A blowout preventor for sealing engagement with a tubular within a wellbore, comprising:

a blowout preventor body with a central bore;

a pair of opposing ram block assemblies, each ram block assembly including a ram block at an inner end of a cylinder rod;

a seal assembly carried by each ram block and radially moveable for sealing engagement and disengagement with the tubular, each seal assembly including a resilient seal for sealingly engaging the tubular and a plurality of inserts at least substantially embedded within the resilient seal for preventing extrusion of the resilient seal, the plurality of inserts arranged to move in an iris pattern to alter a bore diameter of the blowout preventor;

each insert including a generally triangular shaped upper body, a generally triangular shaped lower body, and a rib fixedly interconnecting the upper body and the lower body, each upper body and lower body having a leading face, a trailing face, and a radially outward opposite face;

each of the upper body and the lower body including a circumferentially extending ledge extending from one of the leading face and the trailing face, and a recess in the other of the leading face and the trailing face for receiving an adjacent ledge, each leading face being centrally tangent to the bore at the point of intersecting the bore;

the plurality of inserts move in an iris pattern to alter a bore diameter of the blowout preventor;

an antiextrusion ledge extending from the circumferentially extending ledge of the upper body; and an antiextrusion slot in the trailing face of the upper body for receiving the antiextrusion ledge of an adjacent insert.

13. A blowout preventor as defined in claim 12, wherein the rib of each insert includes a front surface spaced radially outward of a radially innermost surface of the insert and a rear surface spaced radially inward of a radially outermost surface of the insert.

14. A blowout preventor as defined in claim 12, wherein the antiextrusion ledge of each insert includes a curved ramp portion commencing with a starting point spaced radially outward from a radially innermost portion of the leading face.

15. A blowout Preventor as defined in claim 12, wherein each of the ledge in the upper body and the lower body extend from the trailing face.

16. A blowout preventor as defined in claim 12, wherein the antiextrusion ledge of each insert commences with a starting point spaced radially inward of a radially innermost portion of the ledge in the upper body.

17. A blowout preventor for sealing engagement with a tubular within a wellbore, comprising:

a blowout preventor body with a central bore;

a pair of opposing ram block assemblies, each ram block assembly including a ram block at an inner end of a cylinder rod;

a seal assembly carried by each ram block and radially moveable for sealing engagement and disengagement with the tubular, each seal assembly including a resilient seal for sealingly engaging the tubular and a plurality of inserts at least substantially embedded within the resilient seal for preventing extrusion of the resilient seal, the plurality of inserts arranged to move in an iris pattern to alter a bore diameter of the blowout preventor;

each insert including a generally triangular shaped upper body, a generally triangular shaped lower body, and a rib fixedly interconnecting the upper body and the lower body, each upper body and lower body having a leading face, a trailing face, and a radially outward opposite face;

an antiextrusion ledge extending from the leading face of the upper body, wherein the antiextrusion ledge of each insert includes a curved ramp portion commencing with a starting point spaced radially outward from a radially innermost portion of the leading face; and an antiextrusion slot in the trailing face of the upper body for receiving the antiextrusion ledge of an adjacent insert.

18. A blowout preventor as defined in claim 17, wherein the rib of each insert includes a front surface spaced radially outward of a radially innermost surface of the insert and a rear surface spaced radially inward of a radially outermost surface of the insert.

19. A blowout preventor as defined in claim 17, wherein a radial opening between an imaginary apex at the upper body and the starting point of each curved ramp portion is at least 5% of a nominal diameter of the blowout preventor.

20. A blowout preventor as defined in claim 17, wherein the antiextrusion ledge of each insert commences with a starting point spaced radially inward of a radially innermost portion of the ledge in the upper body.

* * * * *